US007845036B2

(12) United States Patent
Rinchetti

(10) Patent No.: US 7,845,036 B2
(45) Date of Patent: Dec. 7, 2010

(54) EDGE SUPPORT FOR MATTRESS ASSEMBLY AND METHOD FOR MAKING AND USING THE SAME

(75) Inventor: Irene R. Rinchetti, North Chelmsford, MA (US)

(73) Assignee: Hickory Springs Manufacturing Company, Hickory, NC (US)

( * ) Notice: Subject to any disclaimer, the term of this patent is extended or adjusted under 35 U.S.C. 154(b) by 258 days.

(21) Appl. No.: 12/114,025

(22) Filed: May 2, 2008

(65) Prior Publication Data

US 2009/0013476 A1 Jan. 15, 2009

Related U.S. Application Data

(60) Provisional application No. 60/948,600, filed on Jul. 9, 2007.

(51) Int. Cl.
*A47C 23/04* (2006.01)

(52) U.S. Cl. ..... 5/739; 5/717; 5/740

(58) Field of Classification Search ..... 5/716, 5/717, 739–740
See application file for complete search history.

(56) References Cited

U.S. PATENT DOCUMENTS

| | | | | |
|---|---|---|---|---|
| 2,152,237 | A * | 3/1939 | Bechik | 5/716 |
| 2,826,769 | A | 3/1958 | Drews | |
| 3,618,146 | A | 11/1971 | Ferdinand | |
| 3,822,426 | A | 7/1974 | Mistarz | |
| 3,854,650 | A | 12/1974 | Hanaue | |
| 4,840,277 | A | 6/1989 | Waldner | |
| 5,133,116 | A | 7/1992 | Wagner et al. | |
| 5,210,890 | A | 5/1993 | Hagglund | |
| 5,724,686 | A | 3/1998 | Neal | |
| 5,787,532 | A | 8/1998 | Langer et al. | |
| 6,128,798 | A | 10/2000 | Barman et al. | |
| 6,263,533 | B1 | 7/2001 | Dimitry et al. | |
| 6,508,362 | B2 | 1/2003 | Hnatow et al. | |
| 6,568,014 | B1 | 5/2003 | Sabalaskey et al. | |
| 7,082,635 | B2 | 8/2006 | Barman et al. | |
| 7,127,765 | B2 | 10/2006 | Ruiz | |
| 7,165,282 | B2 | 1/2007 | Watson | |
| 7,185,379 | B2 | 3/2007 | Barman | |
| 2003/0082343 | A1 | 5/2003 | Brucker | |
| 2006/0031995 | A1 | 2/2006 | Barkhouse | |
| 2006/0260062 | A1 | 11/2006 | Barman et al. | |
| 2006/0278555 | A1 | 12/2006 | Langer et al. | |
| 2007/0083996 | A1 | 4/2007 | Wells | |

* cited by examiner

*Primary Examiner*—Fredrick Conley
(74) *Attorney, Agent, or Firm*—Alston & Bird LLP

(57) ABSTRACT

An edge support for reinforcing an edge of a spring core is provided. The edge support includes a plurality of engaging members that are movable between flat and folded positions. In the flat position, an engaging member is generally aligned with the rest of the edge support. In the folded position, the engaging member extends laterally from the rest of the edge support. With the engaging members in the flat position, the edge support has a relatively thin thickness allowing the edge support to be rolled which may be beneficial for the shipping and handling of the edge support. During the assembling of the mattress, the engaging members may be moved to the folded position such that engaging members extend inwardly into the spring core between the spring coils of the spring core.

22 Claims, 5 Drawing Sheets

EDGE SUPPORT FOR MATTRESS ASSEMBLY AND METHOD FOR MAKING AND USING THE SAME

CROSS-REFERENCE TO RELATED APPLICATIONS

The present application claims the benefit of U.S. Provisional Application No. 60/948,600, filed Jul. 9, 2007, which is hereby incorporated by reference in its entirety.

BACKGROUND

The present invention generally relates to methods and devices for supporting areas within an article of furniture. More particularly, the present invention relates to mattresses or other spring-supported bedding and seating articles with edge supports.

An innerspring mattress is generally formed by encasing a spring core with padding materials and upholstery layers. The spring core includes rows of coil springs, sinusoidal wires, and border wires. The rows of coil springs extend generally along the intended width and length of the mattress. The border wires and sinusoidal wires interconnect the coil springs. Typically, the spring core includes a top border wire that extends around the perimeter of the rows of coil springs near the top of the edge coil springs and a bottom border wire that extends around the perimeter of the rows of coil springs near the bottom of the edge coil springs. Edge coil springs are the first and last coil springs in each row, including the rows that extend along the width of the mattress as well as the rows that extend along the length of the mattress. The sinusoidal wires extend across the rows of coil springs and interconnect the coil springs of the rows together and connect the coil springs to the border wires.

The edges of a mattress tend to deform or wear faster than the rest of the mattress. The edges of a mattress are susceptible to deformation or wear because the edge coil springs lack the additional support of having interconnected adjacent coil springs on all sides as seen in the non-edge coil springs and because people often sit near the edges of the mattresses. Therefore the edges of the mattress tend to sag over a period of time.

Mattress manufactures have used foam edge supports to reinforce the edges of the mattresses. Typically, an edge support extends lengthwise along the length of the border wires and widthwise from the top and bottom border wires. The edge support also extends from and between the border wires inwardly toward the spring coils and defines a thickness of the edge support. In general, the thickness of the edge support provides the reinforcement to the edge of the mattress by positioning portions of the foam material of the edge support between the top and bottom border wires such that the foam material resists the compression of the top and bottom border wires. In some edge supports, the edge support may extend partially into or around the edge spring coils to provide additional reinforcement.

Typically, foam edge supports are made through an extrusion process at a first facility and then shipped to a second facility where the mattresses are assembled. However, known edge supports are relatively thick, which may add to the cost of shipping the edge supports. For example, the thickness of the edge supports is usually great enough to prevent the rolling of the edge supports and instead requires the edge supports to be stacked during shipping and storage. Moreover, the thickness of the edge supports may limit the edge support's ability to be wrapped around the corners of the spring cores.

BRIEF SUMMARY

An edge support for a spring core having a top border wire, a bottom border wire, and a plurality of coil springs, is provided. In an embodiment, the edge support includes an outer side, an inner side, and at least a first engaging member. The first engaging member defines a top recessed area configured to receive the top border wire and a bottom recessed area configured to receive the bottom border wire. The first engaging member is movable between a flat position and a folded position. In the flat position, the first engaging member is generally aligned with the outer side and the inner side of the edge support. In the folded position, the first engaging member extends laterally from the inner side of the edge support.

The edge support may further include a second engaging member and a third engaging member. Each of the first engaging member, the second engaging member, and the third engaging member may be spaced apart such that, in the folded position, the first engaging member is configured to extend between a first set of adjacent coil springs and the top and bottom border wires, the second engaging member is configured to extend between a second set of adjacent coil springs and the top and bottom border wires, and the third engaging member is configured to extend between a third set of adjacent coil springs and the top and bottom border wires.

The outer side and the inner side may define a length of the edge support. For example, the length may be approximately equal to a side of the spring core such that the edge support extends and provides support to the spring core along the side. As another example, the length may be approximately equal to the perimeter of the spring core such that the edge support extends and provides support to the spring core along the perimeter of the spring core.

Each of the first, second, and third engaging members may be movable about a hinge. Also, each of the first, second, and third engaging members may include a first angled shoulder and a second angled shoulder configured to hold the engaging member in the folded position. In some embodiments, each of the first, second, and third engaging members may extend from the first and second angled shoulders to a tapered distal end.

The edge support may be rolled into a roll configuration.

In another embodiment, a mattress assembly is provided. The mattress assembly may include a spring core and an edge support. The spring core may have a top border wire and a bottom border wire extending along a perimeter of the spring core and a plurality of spring coils. The edge support may have an outer side and an inner side and a plurality of engaging members. Each engaging member is moveable from a flat position such that the engaging member is generally aligned with the inner and outer side and a folded position such that the engaging member extends laterally from the inner side of the edge support. In the folded position, the plurality of engaging members are configured to extend generally inwardly into the spring core between the plurality of spring coils.

The edge support may include a top portion that extends above the top border wire and a bottom portion that extends below the bottom border wire. The top portion may be folded over the top border wire and the bottom portion may be folded underneath the bottom border wire to provide padding across the top and bottom border wires. Or the top portion may define a top flange and the bottom portion may define a bottom flange.

The mattress assembly may further include one or more layers of padding and upholstery and a sleeve for encasing at least the edge support and the spring core.

In yet another embodiment a method is provided. The method may include extruding a piece of foam having an inner side and an outer side and defining a length, width, and thickness; cutting a plurality of engaging members along the length of the piece of foam, wherein each engaging member of the plurality of engaging members is movable between a flat position such that the engaging member is generally aligned with the outer side and the inner side of the piece of foam and a folded position such that the engaging member extends laterally from the inner side of the piece of foam; and rolling the piece of foam along its length to form a roll.

The method may further include forming a top recessed area and a bottom recessed area in each of the plurality of engaging members Another embodiment may provide another method. The method may include providing a piece of foam that defines a length, a width, and a thickness and includes an inner side, an outer side, and a plurality of engaging members, wherein each engaging member of the plurality of engaging members is movable between a flat position such that the engaging member is generally aligned with the outer side and the inner side of the piece of foam and a folded position such that the engaging member extends laterally from the inner side of the piece of foam; moving one or more of the plurality of engaging members to the folded position; providing a spring core having a top border wire, a bottom border wire, and a plurality of coil springs; and positioning at least a portion of the piece of foam against at least a portion of the perimeter of the spring core such that the outer side faces away from the spring core, the inner side faces toward the spring core, and the one or more of the plurality of engaging members in the folded position extend generally inwardly into the spring core between one or more coil springs of the spring core.

The method may further include cutting the piece of foam at a predetermined length interval that corresponds to the portion of the perimeter of the spring core.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
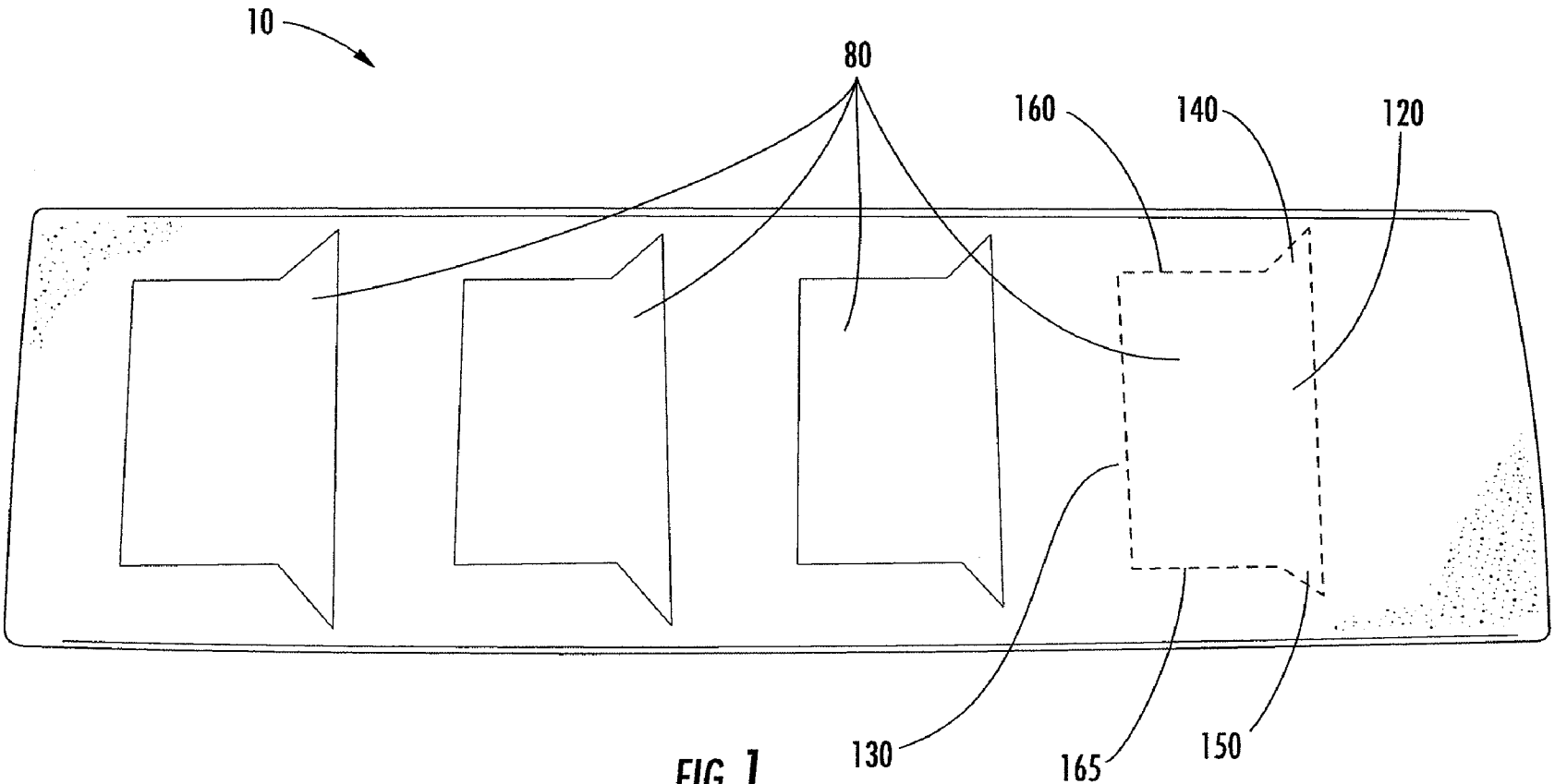
FIG. 1 is a perspective view of the edge support wherein the engaging members are in a flat position according to an embodiment of the present invention.
Figure 2:
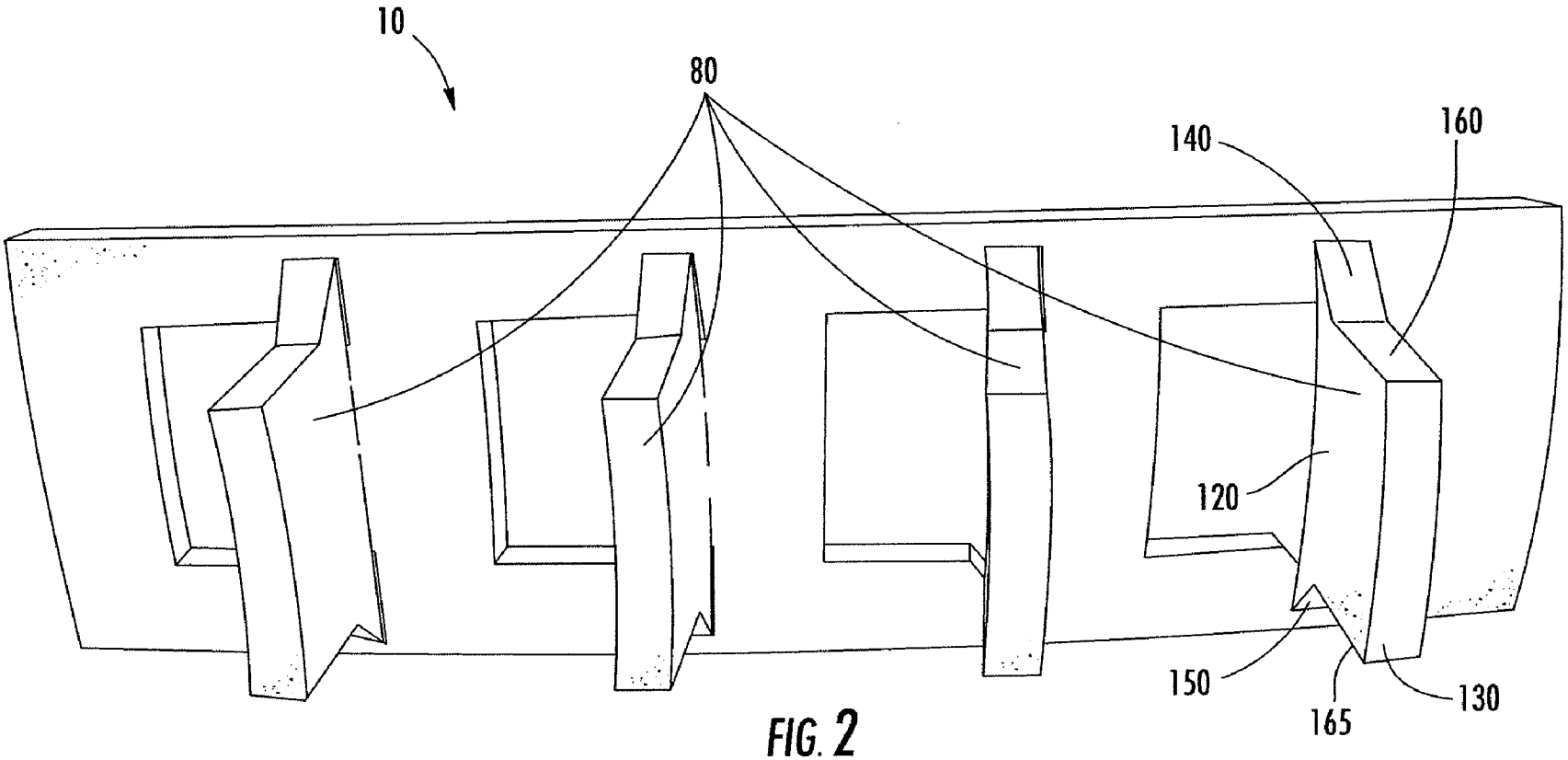
FIG. 2 is a perspective view of the edge support wherein the engaging members are in a folded position according to an embodiment of the present invention.

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention provides a foam edge support for reinforcing an edge of a spring core. The edge support includes a plurality of engaging members that are movable between flat and folded positions. In the flat position, an engaging member is generally aligned with the rest of the edge support. In the folded position, the engaging member extends laterally from the rest of the edge support. With the engaging members in the flat position, the edge support has a relatively thin thickness allowing the edge support to be rolled which may be beneficial for the shipping and handling of the edge support. During the assembling of the mattress, the engaging members may be moved to the folded position such that engaging members extending inwardly into the spring core such that the engaging members may provide reinforcement between the top and bottom border wires. Moreover, even with the engaging members extending inwardly, the rest of the edge support still defines a relative thin thickness facilitating the bending of the edge support around the corners of the spring core.

As illustrated in the figures, the edge support 10 defines a length, width, and thickness. When attached to the spring core 20, the length of the edge support 10 extends along the perimeter of the spring core and, more specifically, along a portion of the border wires 30, 40 and the width of the edge support 10 generally extends from about the top border wire 30 to about the bottom border wire 40. The thickness of the edge support 10 is defined by the distance between an outer side 60 (facing away from the spring core) and an inner side 70 (facing toward the spring core) of the edge support 10.

The engaging members 80 of the edge support 10 may be formed through a die cut process and, thus, the engaging members 80 are sometimes referred to as die-cut engaging members. The process may include making a cut completely through the foam material of the edge support 10 around the perimeter of the engaging member (including a top edge 160, a bottom edge 165, and a distal end 130) except for along a base portion 120 of the engaging member. Along the base portion 120, the cut may be only partially through the foam material to form a hinge, referred to as "hinged foam."

As illustrated, the base portion 120 may be wider than the rest of the engaging member 80 forming two angled shoulders 140, 150. These angled shoulders 140, 150 may be configured to function as stops to help hold the engaging members 80 in the folded position. Once an engaging member 80 is pushed into the folded position, the angled shoulders 140, 150 maintain this orientation by resting on the lip of the remainder of the edge support 10 corresponding to the angled shoulders 140, 150. The two far ends of the opening formed by the movement of the engaging members or, more particularly, the angled shoulders from the flat position to the folded position are smaller than the thickness of the angled shoulders 140, 150. Therefore, in order to move the engaging member from the folded position to the flat portion, a portion of the foam material of the edge support must be overcome. Although this portion of foam material can be overcome when the engaging member 80 is pushed by someone or something, the resistance is great enough to hold the engaging member 80 in place, i.e., in the folded position. Although not illustrated, the engaging members may also include a tapered distal end (i.e., the end opposite the base portion). The tapered distal end may help when inserting the engaging member into the spring core and between adjacent spring coils.

Each of the top and bottom edges 160, 165 of the engaging member may further define a recessed area, such as a slit 170, 175. According to the illustrated embodiment, each slit 170, 175 may be located at end of the hinge that holds the engaging member 80 to the rest of the edge support 10. In other embodiments, the slits 170, 175 may be defined anywhere along the top and bottom edges 160, 165 from the hinge at the bottom of the base portion to the distal end 130 or may be omitted entirely. The slits 170, 175 are adapted to receive and help hold the border wires 30, 40 to the edge support 10. In some embodiments, an adhesive (not illustrated) may be applied to the slits to help hold the border wires and the edge support together.

Figure 3:
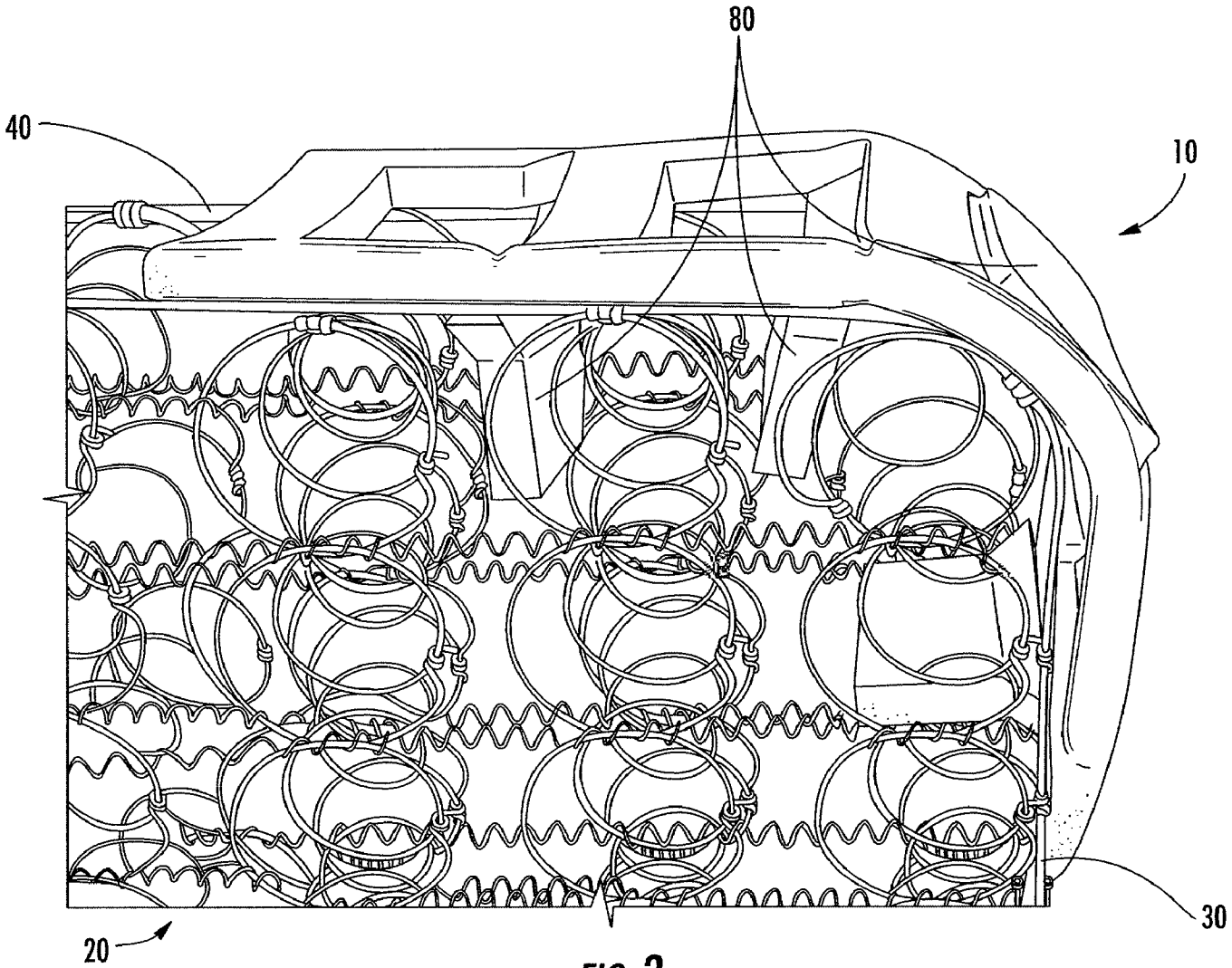
FIG. 3 is a perspective view of an edge support according to an embodiment of the present invention extending around a corner of a spring core.
Figure 4:
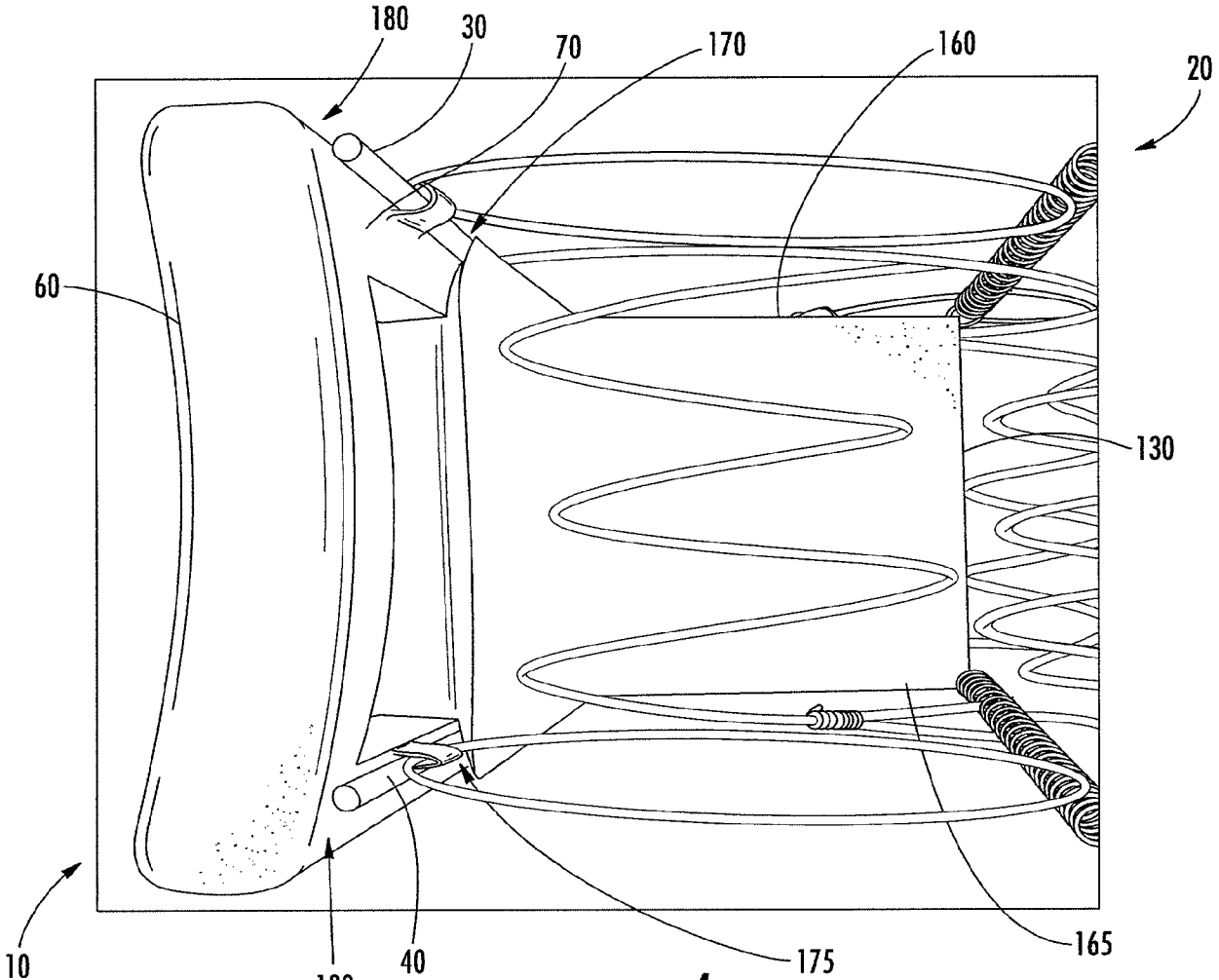
FIG. 4 is a side view of the edge support of FIG. 3.
Figure 5:
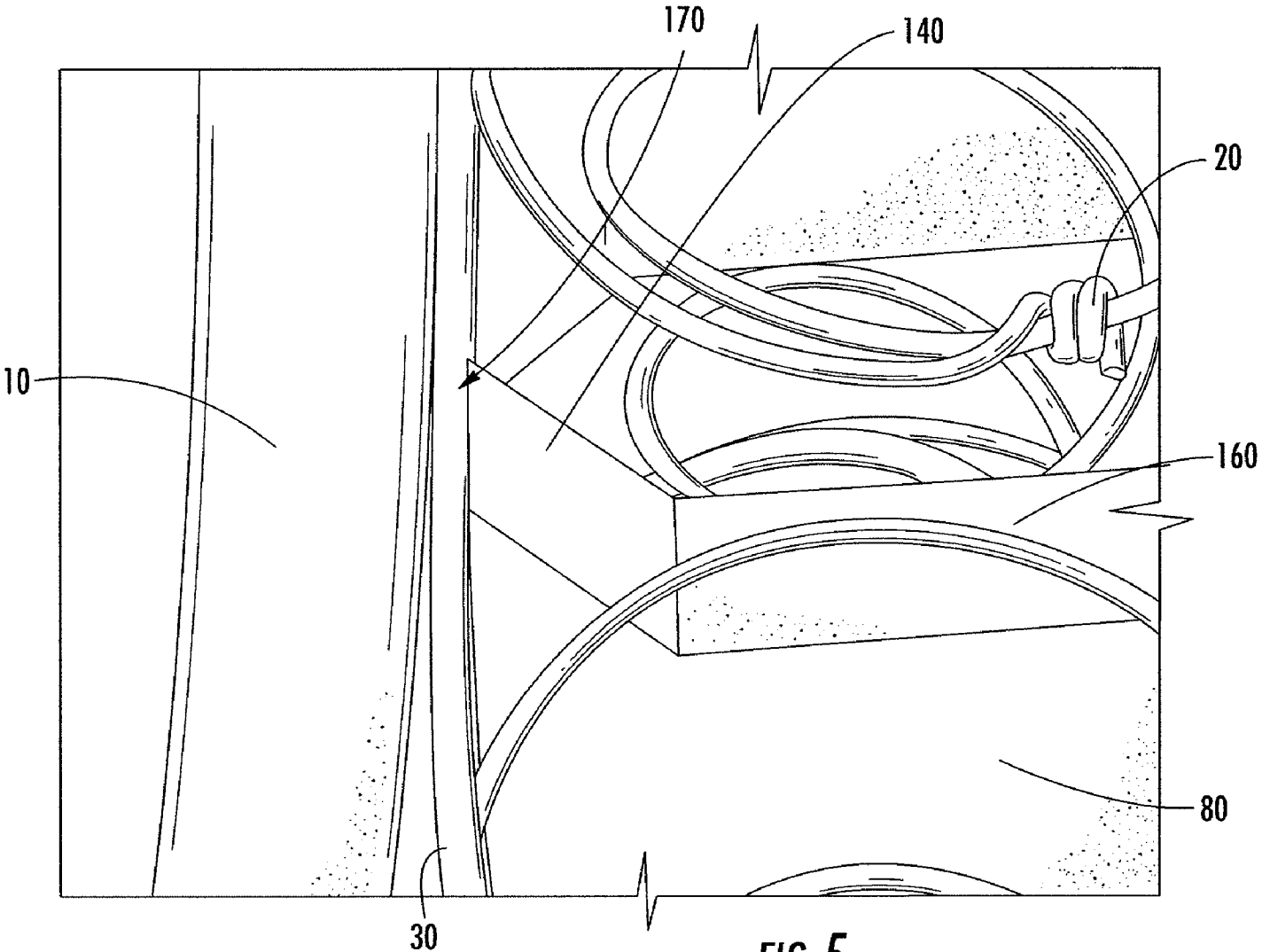
FIG. 5 is partial enlarged view of the recessed areas on the base portion of the engaging member consistent with an embodiment of the present invention.

The engaging members 80 may be spaced along the edge support 10 such that one or more of the engaging members 80, when in the folded position, extend inwardly and between the adjacent coils of the spring core 20. During the assembly of the mattress, it may not be necessary to move each engaging members into the folded position. For example, as shown in FIG. 3, in the area of the edge support 10 that corresponds to the corner of the spring core 20, one or more engaging members may be left in the flat position in order to prevent interference with a spring coil due to uneven spacing between the engaging members 80 and the spring coils that may occur at the corner.

As shown in the figures, the edge support 10 may include top and bottom portions 180, 190 that extend beyond the border wires 30, 40 of the spring core. These portions 180, 190 may be folded over the border wires 30, 40 during the assembly of the mattress and provide additional padding across the border wires 30, 40. Moreover, the additional padding may help reduce or muffle any sounds created by the spring core or between the mattress and the box spring below. Alternatively, these top and bottom portions 180, 190 may define flanges that extend along the perimeter of layers of padding added to the top and bottom of the spring core during the assembly of the mattress. In yet another embodiment, the top and bottom portions 180, 190 may include slits (not illustrated) for receiving the top and bottom border wires 30, 40.

Other embodiments of the present invention may provide methods for forming an edge support and assembling a mattress. The edge support may be formed by a foam material that has undergone an extrusion process. For example, the foam material may be extruded polyethylene. After the extrusion process, the engaging members may be formed through a die-cutting process as discussed above. The distance between the engaging members and the position of the engaging members along the length of the edge support may vary. As an example, the spacing may be determined by the spacing of, and distance between, the edge spring coils on a spring core of the mattress. The length of the edge support may vary. For example, the length of the edge support may be approximate the length of one side of a spring core or substantially equal to the perimeter of a spring core such that the edge support can be completely wrapped around the spring core. During the manufacturing of the edge support, the length of the extruded foam and die cut engaging members may equal multiple sides or perimeters of spring cores. The extruded foam and die cut engaging members may be rolled and then shipped to a mattress assembler who may cut the extruded foam and die cut engaging into several edge supports in order to assembly multiple mattresses or types of mattresses. Alternatively, individual edge supports may be rolled and shipped to the mattress assembler.

During the assembly of the mattress, the edge support may be wrapped around the spring core and the engaging members moved to the folded positions. The slits along the edges of the engaging members may receive the top and bottom border wires of the spring core to hold the edge support and the spring core together. After the edge support is wrapped around and held to the spring core, padding material and upholstery layers can be added to complete the construction of the mattress. Typically, a sleeve or cover is used to encase the entire spring core. The application of the sleeve or cover often may be effective in holding any edge support to the spring core over the life of the mattress.

Although the process above generally describes the edge support being wrapped around the spring core, in other embodiments, more than one edge support may be used per spring core. As an example, a different edge support may be used for each side of the spring core.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An edge support for a spring core having a top border wire, a bottom border wire, and a plurality of coil springs, the edge support comprising:

an outer side;

an inner side; and a first engaging member defining a top recessed area configured to receive the top border wire and a bottom recessed area configured to receive the bottom border wire and is movable between a flat position and a folded position, and wherein, in the flat position, the first engaging member is generally aligned with the outer side and the inner side of the edge support and, in the folded position, the first engaging member extends laterally from the inner side of the edge support into the spring core between the top border wire and the bottom border wire.

2. The edge support of claim 1 further comprising at least a second engaging member and a third engaging member, and wherein the first engaging member, the second engaging member, and the third engaging member are spaced apart such that, in the folded position, the first engaging member is configured to extend between a first set of adjacent coil springs and the top and bottom border wires, the second engaging member is configured to extend between a second set of adjacent coil springs and the top and bottom border wires, and the third engaging member is configured to extend between a third set of adjacent coil springs and the top and bottom border wires.

3. The edge support of claim 2, wherein the outer side and the inner side define a length of the edge support approximately equal to a side of the spring core such that the edge support extends and provides support to the spring core along the side.

4. The edge support of claim 2, wherein the outer side and the inner side define a length approximately equal to the perimeter of the spring core such that the edge support extends and provides support to the spring core along the perimeter of the spring core.

5. The edge support of claim 2, wherein each of the first, second, and third engaging members is movable about a hinge.

6. The edge support of claim 5, wherein each of the first, second, and third engaging members includes a first angled shoulder and a second angled shoulder configured to hold the engaging member in the folded position.

7. The edge support of claim 6, wherein each of the first, second, and third engaging members extends from the first and second angled shoulders to a tapered distal end.

8. The edge support of claim 1, wherein the edge support is in a rolled configuration.

9. A mattress assembly comprising:

a spring core having a top border wire and a bottom border wire extending along a perimeter of the spring core and a plurality of spring coils; and an edge support having an outer side and an inner side and comprising a plurality of engaging members, wherein each engaging member is moveable from a flat position such that the engaging member is generally aligned with the inner and outer side and a folded position such that the engaging member extends laterally from the inner side of the edge support;

wherein, in the folded position, the plurality of engaging members are configured to extend generally inwardly into the spring core between the plurality of spring coils.

10. The mattress assembly of claim 9, wherein the edge support defines a length approximately equal to a side of the spring core such that the edge support is configured to extend along the side.

11. The mattress assembly of claim 9, wherein the edge support defines a length approximately equal to the perimeter of the spring core such that the edge support is configured to extend along the perimeter of the spring core.

12. The mattress assembly of claim 9, wherein each of the plurality of engaging members is movable about a hinge.

13. The mattress assembly of claim 12, wherein each of the plurality of engaging members includes a first recessed area configured to receive the top border wire and a second recessed area configured to receive the bottom border wire.

14. The mattress assembly of claim 12, wherein each of the plurality of engaging members includes a first angled shoulder and a second angled shoulder configured to hold the engaging member in the folded position.

15. The mattress assembly of claim 9, wherein the edge support includes a top portion that extends above the top border wire and a bottom portion that extends below the bottom border wire.

16. The mattress assembly of claim 15, wherein the top portion is folded over the top border wire and the bottom portion is folded underneath the bottom border wire to provide padding across the top and bottom border wires.

17. The mattress assembly of claim 15, wherein the top portion defines a top flange and the bottom portion defines a bottom flange.

18. The mattress assembly of claim 9 further comprising one or more layers of padding and upholstery and a sleeve for encasing at least the edge support and the spring core.

19. A method comprising:

extruding a piece of foam having an inner side and an outer side and defining a length, width, and thickness;

cutting a plurality of engaging members along the length of the piece of foam, wherein each engaging member of the plurality of engaging members is movable between a flat position such that the engaging member is generally aligned with the outer side and the inner side of the piece of foam and a folded position such that the engaging member extends laterally from the inner side of the piece of foam; and rolling the piece of foam along the length of the piece to form a roll.

20. The method of claim 19 further comprising forming a top recessed area and a bottom recessed area in each of the plurality of engaging members.

21. A method comprising:

providing a piece of foam that defines a length, a width, and a thickness and includes an inner side, an outer side, and a plurality of engaging members, wherein each engaging member of the plurality of engaging members is movable between a flat position such that the engaging member is generally aligned with the outer side and the inner side of the piece of foam and a folded position such that the engaging member extends laterally from the inner side of the piece of foam;

moving one or more of the plurality of engaging members to the folded position;

providing a spring core having a top border wire, a bottom border wire, and a plurality of coil springs;

positioning at least a portion of the piece of foam against at least a portion of the perimeter of the spring core such that the outer side faces away from the spring core, the inner side faces toward the spring core, and the one or more of the plurality of engaging members in the folded position extend generally inwardly into the spring core between one or more coil springs of the spring core.

22. The method of claim 21 further comprising cutting the piece of foam at a predetermined length interval that corresponds to the portion of the perimeter of the spring core.

* * * * *